US006220351B1

(12) United States Patent
Tovar De Pablos

(10) Patent No.: US 6,220,351 B1
(45) Date of Patent: Apr. 24, 2001

(54) SYSTEM TO LOWER THE DEPTH EQUIPMENT IN HYDROCARBONS WELLS

(76) Inventor: Juan José Tovar De Pablos, 7 rue Islaw Terrace, Aberdeen (GB), AV10 1XE ( * ) Notice: Subject to any disclaimer, the term of this patent is extended or adjusted under 35 U.S.C. 154(b) by 0 days.

(21) Appl. No.: 09/308,462

(22) PCT Filed: Oct. 20, 1997

(86) PCT No.: PCT/IB97/01290

§ 371 Date: Jun. 18, 1999

§ 102(e) Date: Jun. 18, 1999

(87) PCT Pub. No.: WO98/22691

PCT Pub. Date: May 28, 1998

(30) Foreign Application Priority Data

Nov. 19, 1996 (IT) ..... BO96A0591

(51) Int. Cl.[7] ..... E21B 17/10
(52) U.S. Cl. ..... 166/242.3; 166/189
(58) Field of Search ..... 166/242.3, 241.6, 166/189, 342, 343

(56) References Cited

U.S. PATENT DOCUMENTS

| | | | | |
|---|---|---|---|---|
| 2,970,648 | * | 2/1961 | Daffin et al. | 166/147 |
| 3,048,358 | | 8/1962 | Raulins et al. . | |
| 3,330,349 | * | 7/1967 | Owsley et al. | 166/285 |
| 3,434,682 | | 3/1969 | Nestlerode, Sr. . | |
| 3,899,631 | | 8/1975 | Clark . | |
| 3,907,355 | | 9/1975 | Carothers . | |
| 4,023,371 | | 5/1977 | Bryant, Jr. . | |
| 4,396,230 | | 8/1983 | Wood et al. . | |
| 4,616,704 | * | 10/1986 | Johnston | 166/242.3 |
| 4,798,243 | | 1/1989 | Curington et al. . | |
| 5,226,485 | | 7/1993 | Dobscha et al. . | |
| 5,429,194 | | 7/1995 | Nice . | |
| 5,478,970 | | 12/1995 | Lawler et al. . | |
| 5,553,666 | | 9/1996 | Hartman . | |

FOREIGN PATENT DOCUMENTS

| | | |
|---|---|---|
| 27 17 713 | 10/1978 | (DE) . |
| 0 651 130 | 5/1995 | (EP) . |
| 2 138 056 | 10/1984 | (GB) . |
| 2 201 177 | 8/1988 | (GB) . |
| WO 93/20327 | 10/1993 | (WO) . |

* cited by examiner

*Primary Examiner*—William Neuder
(74) *Attorney, Agent, or Firm*—Brown, Martin, Haller & McClain, LLP

(57) ABSTRACT

A sliding link or connection apparatus for use in lowering an auxiliary conduit or other equipment into a well casing alongside a production pipe is of predetermined shape and dimensions different from, and smaller than, the shape and dimensions of the well casing. The link has a first through bore for sliding engagement over the production pipe, and a second through bore for securing over a conduit or equipment casing to be lowered.

4 Claims, 2 Drawing Sheets

SYSTEM TO LOWER THE DEPTH EQUIPMENT IN HYDROCARBONS WELLS

BACKGROUND OF THE INVENTION

This invention relates generally to equipment such as production pipes, auxiliary conduits, and the like as used in hydrocarbon extraction wells for performing the necessary electric, hydraulic, and mechanical operations in the well, and is particularly concerned with a sliding link or connector apparatus for use in lowering an auxiliary conduit or the like alongside a production pipe.

U.S. Pat. No. 3,907,355 describes a tubing retrieval mechanism for use in a well. The mechanism engages slidably over an existing tubing string which acts as a guide for a tubing retrieval spear as it is lowered into the well. The mechanism comprises an elongate retrieval element which generally conforms to the internal dimensions and shape of the well casing, and which has two guide passageways, one of which is shaped and dimensioned for sliding engagement over an existing tubing string, and the other being dimensioned for close fitting over a separate tubular string. This system is not readily adaptable to well casings of different sizes and shapes, and may be difficult to maneuver.

SUMMARY OF THE INVENTION

It is an object of the present invention to provide a new and improved sliding connection apparatus for a hydrocarbon extraction well.

According to the present invention, a sliding connection apparatus for a well is provided, which comprises a body having an outer shape and dimensions which do not conform to the shape and dimensions of a well casing, and which fits readily inside the well casing, the body having a first through bore for sliding engagement over a first tubular element positioned in the well casing, and a second through bore for securing over a second tubular element to be lowered into the well.

The body has a width greater than its length in an exemplary embodiment, and has a first part-cylindrical portion containing the first through bore, a second part-cylindrical portion containing the second through bore, and a connecting portion extending between the first and second portions.

The sliding connection apparatus or link is smaller and lighter than previous sliding links as used in similar applications, and may be used in well casings of different dimensions, since it is not a close sliding fit in the casing, unlike prior art arrangements. It is more economical as well as more readily maneuverable than previous systems.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 2:
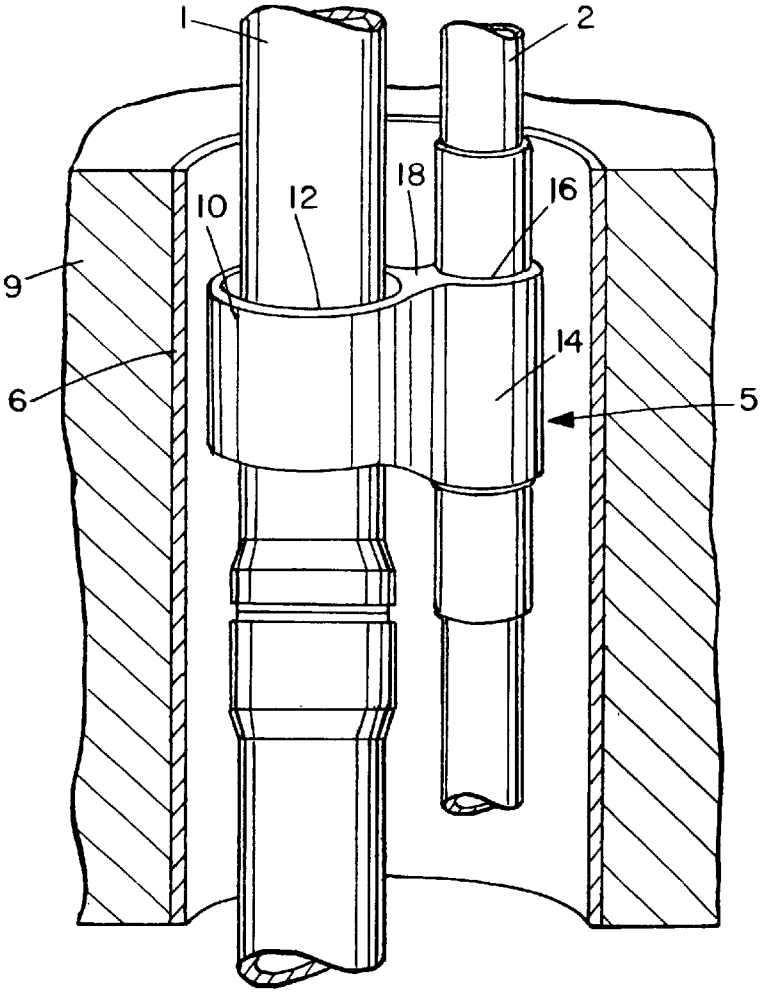
FIG. 2 is a view similar to FIG. 1 illustrating use of a sliding connection apparatus according to an exemplary embodiment of the invention.
Figure 1:
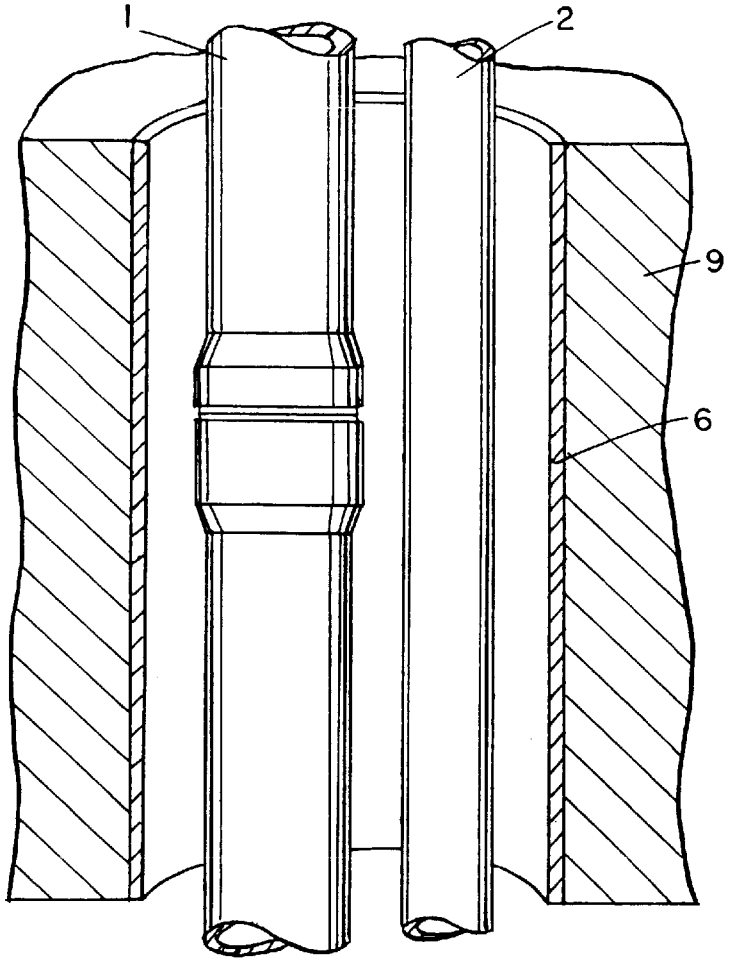
FIG. 1 is a fragmentary sectional view of part of an extraction well inside which two tubular elements are inserted.

FIG. 1 illustrates a typical extraction well casing 6 extending through the surrounding earth 9, with a production pipe 1 and a service pipe 2 extending alongside one another through the casing 6. Lengths of the service pipe 2 may be lowered into the well alongside the production pipe 1 using a sliding link or connection apparatus 5 according to an embodiment of this invention, as generally illustrated in FIG. 2.

The sliding link or apparatus 5 basically comprises a body having a first part-cylindrical portion 10 with a through bore 12 and a second part-cylindrical portion 14 having a through bore 16, and a linking or connecting portion 18 connecting the portions 10 and 14. The part-cylindrical portions are relatively thin-walled and compact. The overall outer shape of the body is not cylindrical, but basically comprises two ring-shaped portions connected by link or portion 18, and the dimensions are considerably less than the internal diameter of casing 6. This means that the body can be readily fitted into well casings of various dimensions, and it is relatively small and lightweight.

The bore 12 is of larger diameter than pipe 1, so that it can engage and slide freely over the pipe along the inside of casing 6. The bore 16 is of diameter close to the diameter of the service or auxiliary conduit 2, so that it is a tight fit over the conduit 2 and can be used to lower the conduit into the well, while the pipe 1 acts as a guide to ensure that the conduit 2 is held away from the wall of casing 6 as well as the pipe 1.

Figure 4:
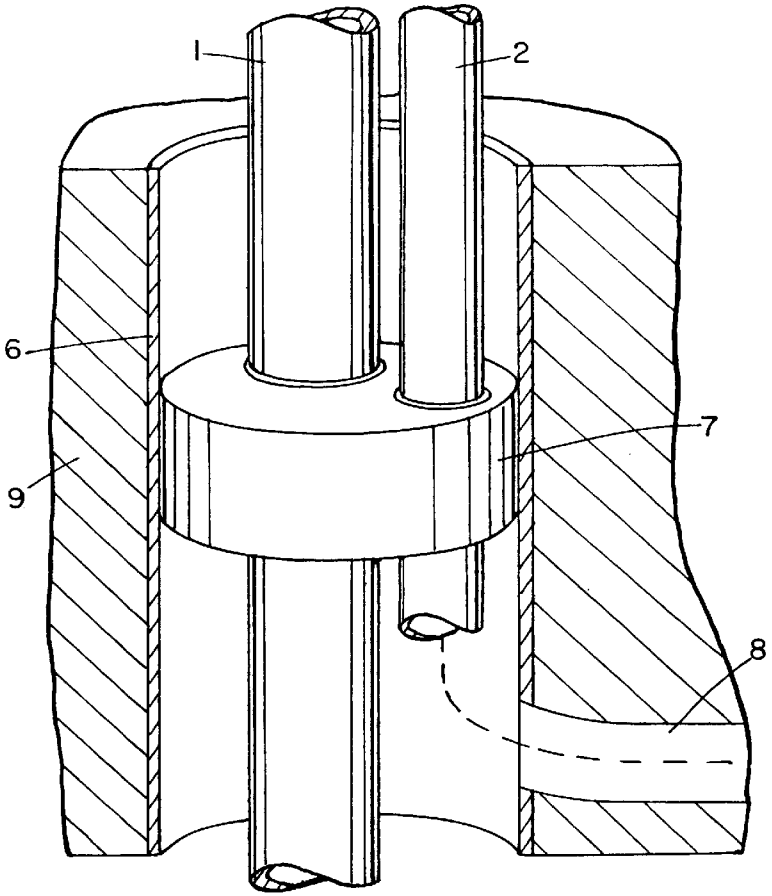
FIG. 4 illustrates the plugging zone of a well close to a side branch.
Figure 3:
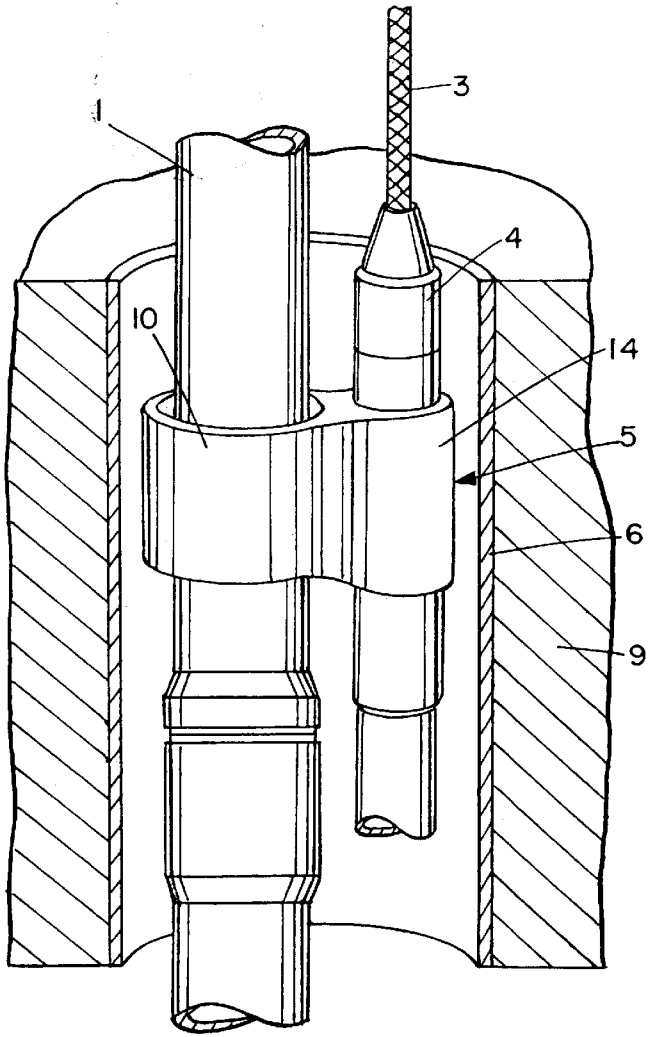
FIG. 3 is a view similar to FIG. 2, illustrating use of a service wire in conjunction with the connection apparatus.

Use of the apparatus 5 to lower equipment 4 with a service wire 3 is illustrated in FIG. 3. An auxiliary conduit 2 can be passed through a plugging zone 7 of a well close to a side branch 8, as illustrated in FIG. 4, using a sliding link or connector apparatus as illustrated in FIG. 2 in order to properly align the conduit 2 with a bore in the plugging zone.

Although an exemplary embodiment of the invention has been described above by way of example only, it will be understood by those skilled in the field that modifications may be made to the disclosed embodiment without departing from the scope of the invention, which is defined by the appended claims.

I claim:

1. A sliding connection apparatus for lowering a tubular element in a hydrocarbon well, comprising:

a body having an outer shape and dimensions different from the shape and dimensions of a well casing in which the body is to be lowered; and the body having a first through bore for sliding engagement over a first tubular element positioned in the well casing, and a second through bore for securing over a second tubular element to be lowered into the well alongside the first tubular element.

2. The apparatus as claimed in claim 1, wherein the body is of non-cylindrical shape.

3. The apparatus as claimed in claim 1, wherein the body has a first part-cylindrical portion through which said first bore extends, a second part-cylindrical portion through which said second bore extends, and a connecting portion extending between said part-cylindrical portions.

4. A well equipment assembly, comprising:

a well casing of predetermined cross-sectional dimensions and shape;

a first tubular element extending inside the well casing;

a second tubular element to be lowered in the casing alongside the first tubular element; and a sliding link of smaller cross-sectional dimensions than the casing and having a different cross-sectional shape to that of the casing;

the link having a first through bore slidably engaged over the first tubular element, and a second through bore secured over the second tubular element;

whereby the sliding link and second tubular element can be lowered into the well with the first tubular element acting as a guide for alignment of the second tubular element.

* * * * *